United States Patent [19]

Sugimoto

[11] 4,135,670

[45] Jan. 23, 1979

[54] SHOWER DEVICE

[75] Inventor: Yoshio Sugimoto, Kishiwada, Japan

[73] Assignee: TSD Kabushiki Kaisha, Izumi-Ohtsu, Japan

[21] Appl. No.: 738,330

[22] Filed: Nov. 2, 1976

[30] Foreign Application Priority Data

Jan. 10, 1976 [JP] Japan ..... 51-2362

[51] Int. Cl.[2] ..... E03C 1/084

[52] U.S. Cl. ..... 239/428.5; 231/553.3

[58] Field of Search ..... 239/428.5, 430, 553.3, 239/558; 128/66

[56] References Cited

U.S. PATENT DOCUMENTS

| | | | |
|---|---|---|---|
| 2,247,310 | 6/1941 | Rockwood | 239/558 X |
| 2,247,311 | 6/1941 | Rockwood | 239/428.5 X |
| 3,450,350 | 6/1969 | Gullaksen | 239/428.5 |

FOREIGN PATENT DOCUMENTS

| | | | |
|---|---|---|---|
| 552684 | 7/1931 | Fed. Rep. of Germany | 128/66 |

*Primary Examiner*—Robert W. Saifer

*Attorney, Agent, or Firm*—Donald D. Jeffery

[57] ABSTRACT

A shower device having a water injecting portion consisted of a nozzle plate having a plurality of nozzles thereon and a cover having water jet holes of the same number positioned respectively to correspond to said nozzles at a given distance. Said nozzles and water jet holes are all tapered to have a smaller diameter towards the outlet side of the device. Between the cover and the nozzle plate, an air chamber is formed by means of which air is sucked in by the gushing water, and jetted out in a state of minute foam mixed with water. When the water jet strikes against one's body, the minute foam ruptures in succession generating minute pulsations and supersonic waves thereby to provide a massage and hot spring bath effect. The shower device is simple, easy to fabricate, and handy to use and disassemble for cleaning.

2 Claims, 1 Drawing Figure

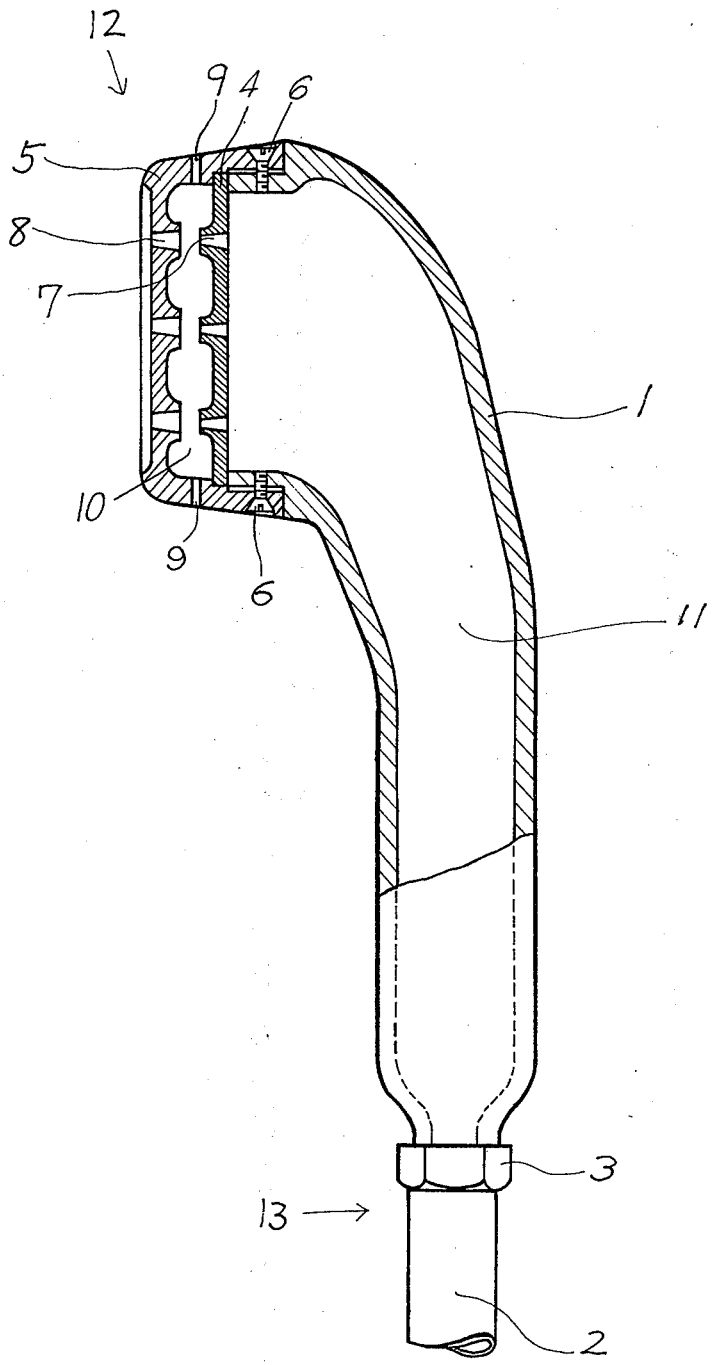
12
9
4
6
5
8
7
1
10
9
6
11
3
13
2

SHOWER DEVICE

BACKGROUND AND SUMMARY OF THE INVENTION

The present invention relates to a shower device of the type generally used in a residential bathroom.

Shower devices which have hitherto been in use in households function only for washing the soiled body or overpouring clean water at the finish of the shower or bath. The concept of the shower device according to the present invention aims at promoting health and beauty in addition to the cleansing effect of the shower device.

BRIEF DESCRIPTION OF THE APPLICATION DRAWING

The invention disclosed is with reference to an embodiment illustrated by the accompanying drawing which shows a longitudinal side view of the shower device, partly broken.

DETAILED DESCRIPTION OF THE PREFERRED EMBODIMENT

The illustrated embodiment of the invention is a hand shower type in which its water injecting portion 12 is so arranged as to inject water in a direction at right angles to the longitudinal axis of casing 1. The water inlet portion 13 of casing 1 is fitted to one end of a hose 2 by means of a fitting nut 3, said hose 2 being connected to a water source (not shown in the drawing).

The water injecting portion 12 of casing 1 consists of a nozzle plate 4 and a cover 5, the nozzle plate 4 being held tightly between the cover 5 and the outer edge of casing 1 when the cover 5 is mounted on the casing 1 by means of screws 6 provided thereon. The nozzle plate 4 has nozzles 7 in a optional number, and the cover 5 has water jet holes 8 of the same number and positioned to correspond to the nozzles 7 at a given distance. In the embodiment shown, the outer end of each nozzle 7 is aligned with and spaced from the inner end of each water jet hole 8. However, the nozzles and jet holes may be connected with each other along the same axis without being adhered so as to provide a space to allow air to come therebetween. The nozzles and water jet holes are more effective in their function when they are all tapered to have a smaller diameter towards the outside or outlet end of the device. Further, it will be more advantageous if the outlet side of nozzle 7 is made smaller in diameter than the inlet side of water jet hole 8.

The cover 5 has at its periphery a plurality of air inlet holes 9, and an air chamber 10 is formed between cover 5 and nozzle plate 4 for atmospheric circulation.

Regarding the shape and/or quality of material of the casing 1 and its water injecting portion 12, or the method of fitting nozzle plate 4 and cover 5 to casing 1, alternatives may be employed, and these features do not constitute important elements of the invention. However, the arrangement of nozzle plate 4 held tightly between cover 5 and the opening edge of casing 1 such as shown in the application drawing is advantageous and convenient from the standpoint of the fabrication process and disassembly of the device for cleaning.

Describing the operation of the invention, casing 1 is filled with hot or cold water by hose 2. From the housing or chamber 11 formed by casing 1 and the nozzle plate 4, the water is jetted out through plural nozzles 7 of nozzles plate 4 against water jet holes 8 under a pressure approximately the same as that of the water source. At this time, the hot or cold water rapidly reaches the water jet holes 8 of cover 5 via air chamber 10 at a velocity which is dependent on the water pressure in housing 11. The water gushing out of nozzles 7 reaches water jet holes 8 in such a state that the water sucks up the air within air chamber 10 when it passes therethrough. The hot or cold water spouted into water jet holes 8 is thereby transformed into a minute mixture of air and water to be jetted out of the shower device over any desired part of the body. Since air chamber 10 always contains a sufficient quantity of air absorbed through air inlet holes 9 provided in cover 5, the jetting force of the water never decreases sufficiently due to the air pressure within air chamber 10 becoming negative relative to atmospheric. Therefore, there is never a shortage of air caused by the water filled in air chamber 10, or is the jetting force of the water itself decreased to any extent. Therefore, the object of the shower device of the present invention is attained as desired with respect to the nature and the force of the water jet.

When the shower device is used, its water jet is made to contain a multitude of foam groups which comprises minute foams respectively independent, and when the water jet strikes against the body, foam groups impinge on the body intermittently and continuously, with the foam rupturing in succession. This generates minute pulsations in the shocks that the water jet gives to the body. Since such pulsations cause minute vibrations on the body, and the rupture of the foam generates supersonic waves, the minute vibrations together with the supersonic waves produce an efficacy of massage, thereby improving the circulation of blood, cleansing even soiled pores of the skin, and washing off dirt and fat through emulsification. Additionally, due to the calorific effect of supersonic waves, the body is warmed from within in the same way as taking a hot spring bath.

As aforementioned, the shower device according to the present invention is not complicated or large scaled in its construction. It is a simple device and easy to use for any person, yet having a remarkable effect of massage and hot spring bath as well.

The shower device of this invention will prove to be more effective in its function when it is used with a water source of comparatively high pressure.

I claim:

1. A shower device having a water injecting portion comprising a casing adapted to be connected to a water source and including a chamber to which water is supplied under pressure, a nozzle plate having a plurality of nozzles formed therein, a cover having an outer end face formed with water jet holes corresponding in number to said nozzles and aligned therewith, said face of said cover being spaced at all points from said plate so as to form a continuous air chamber therebetween, said cover being further formed with a plurality of individual air inlet openings around the circumference thereof directly communicating with said air chamber for admitting air into said chamber, and means for securing said cover and said plate, in said spaced relationship, to said casing, said securing means comprising screw members fixedly attaching said cover to said casing, said cover being formed with an annular recess for receiving said plate, and said casing including a cylindrical outer end portion which engages said plate and forces the same against a wall of said recess to retain said plate in position.

2. The shower device of claim 1 in which said nozzles and water jet holes are tapered to have a smaller diameter towards the outlet end of said device, wherein the outlet side of each nozzle is smaller in diameter than the inlet side of each water jet hole.

* * * * *